US009165504B2

(12) United States Patent
Ha

(10) Patent No.: US 9,165,504 B2
(45) Date of Patent: Oct. 20, 2015

(54) METHOD OF CONTROLLING A DIMMING OPERATION AND ORGANIC LIGHT EMITTING DISPLAY DEVICE PERFORMING THE SAME

(71) Applicant: Samsung Display Co., Ltd., Yongin, Gyeonggi-Do (KR)

(72) Inventor: Sang-Kwon Ha, Yongin (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 15 days.

(21) Appl. No.: 14/107,521

(22) Filed: Dec. 16, 2013

(65) Prior Publication Data

US 2014/0192103 A1 Jul. 10, 2014

(30) Foreign Application Priority Data

Jan. 9, 2013 (KR) ..... 10-2013-0002487

(51) Int. Cl.

| | |
|---|---|
| ***G09G 5/10*** | (2006.01) |
| ***G09G 3/32*** | (2006.01) |
| ***G09G 3/20*** | (2006.01) |

(52) U.S. Cl.

CPC ..... *G09G 3/3258* (2013.01); *G09G 3/2014* (2013.01); *G09G 3/2022* (2013.01); *G09G 3/2081* (2013.01); *G09G 2300/0809* (2013.01); *G09G 2310/0262* (2013.01); *G09G 2320/045* (2013.01)

(58) Field of Classification Search

None

See application file for complete search history.

(56) References Cited

U.S. PATENT DOCUMENTS

| | | | | |
|---|---|---|---|---|
| 2012/0032995 | A1 | 2/2012 | Lee | |
| 2012/0062613 | A1 | 3/2012 | Park et al. | |
| 2012/0281027 | A1* | 11/2012 | Kim | 345/690 |
| 2013/0249955 | A1* | 9/2013 | Kim et al. | 345/690 |

FOREIGN PATENT DOCUMENTS

| | | |
|---|---|---|
| KR | 10-2010-0045657 | 5/2010 |
| KR | 10-2012-0013602 | 2/2012 |
| KR | 10-2012-0028426 | 3/2012 |

* cited by examiner

*Primary Examiner* — Muhammad N Edun

(74) *Attorney, Agent, or Firm* — Robert E. Bushnell, Esq.

(57) ABSTRACT

A method of controlling a dimming operation of an organic light emitting display device that includes an organic light emitting element, a first transistor connected to a data line and a gate line, and a second transistor connected to the first transistor and the organic light emitting element, is provided. By the method, image data is compensated using a plurality of look-up tables respectively corresponding to a plurality of dimming modes, to be outputted compensation data. The compensation data are converted to a data voltage to be provided the organic light emitting element with the data voltage. A level of a current applied to the organic light emitting element is adjusted according to the dimming.

15 Claims, 12 Drawing Sheets

METHOD OF CONTROLLING A DIMMING OPERATION AND ORGANIC LIGHT EMITTING DISPLAY DEVICE PERFORMING THE SAME

CLAIM OF PRIORITY

This application makes reference to, incorporates the same herein, and claims all benefits accruing under 35 U.S.C. §119 from an application earlier filed in the Korean Intellectual Property Office on 9 Jan. 2013 and there duly assigned Serial No. 10-2013-0002487.

BACKGROUND OF THE INVENTION

1. Field of the Invention

An embodiment of the present invention relates generally to an organic light emitting display device, and more particularly, to a method of controlling a dimming operation and an organic light emitting display device performing the method of controlling the dimming operation.

2. Description of the Related Art

Generally, an organic light emitting display device includes an organic light emitting display panel. The organic light emitting display panel includes a plurality of organic light emitting elements respectively corresponding to a plurality of sub-pixels.

Each organic light emitting element includes two electrodes and an organic light emitting layer. The organic light emitting layer is disposed between the electrodes and emits by an electric field caused between the electrodes. One of the electrodes is a transparent electrode so that the organic light emitting element emits light to an outside through the transparent electrode in order to display an image. Generally, the organic light emitting element is driven in a current driving mode.

The organic light emitting display panel further includes two transistors which are electrically connected to the organic light emitting element and drive the organic light emitting element. An image displayed on the organic light emitting display panel may include a display stain occurred by a threshold voltage distribution according to voltage-current characteristic of the transistors in the organic light emitting display panel.

The above information disclosed in this Background section is only for enhancement of understanding of the background of the described technology and therefore it may contain information that does not form the prior art that is already known in this country to a person of ordinary skill in the art.

SUMMARY OF THE INVENTION

An aspect of the present invention provides a method of controlling a dimming operation capable of minimizing or preventing a display stain.

Another aspect of the present invention provides an organic light emitting display device for performing the method of controlling the dimming operation.

In accordance with an embodiment of the present invention, a method of controlling a dimming operation of an organic light emitting display device that includes an organic light emitting element, a first transistor connected to a data line and a gate line, and a second transistor connected to the first transistor and the organic light emitting element, may include a step of compensating image data using a plurality of look-up tables respectively corresponding to a plurality of dimming modes, to output compensation data corresponding to the image data, a step of converting the compensation data to a data voltage to provide the organic light emitting element with the data voltage, and a step of adjusting a level of a current applied to the organic light emitting element according to each of the dimming modes.

In example embodiments, the adjusting the level of the current may include a step of providing a third transistor with a current-control voltage having a voltage difference with respect to a first source voltage, the voltage difference being different according to the dimming mode, the third transistor including an input electrode receiving the first source voltage, a control electrode receiving the current-control voltage and an output electrode connected to the second transistor.

In example embodiments, the compensation data stored in the plurality of look-up tables may be determined based on a plurality of reference points predetermined on a voltage-current curve of the third transistor.

In accordance with another embodiment of the present invention, a method of controlling a dimming operation of an organic light emitting display device that includes an organic light emitting element, a first transistor connected to a data line and a gate line, and a second transistor connected to the first transistor and the organic light emitting element, may include a step of compensating image data using a look-up table to output compensation data, and a step of adjusting a pulse width of a scan signal applied to the gate line according to on each of a plurality of dimming modes.

In example embodiments, the adjusting the pulse width may include a step of adjusting the pulse width of the scan signal to a first pulse width in a high dimming mode, and a step of adjusting the pulse width of the scan signal to a second pulse width less than the first pulse width in a low dimming mode.

In example embodiments, the method may further include a step of providing the organic light emitting element with a current of a level fixed without reference to the dimming mode.

In example embodiments, the adjusting the pulse width may include a step of providing a third transistor with a current-control voltage having a voltage difference with respect to a first source voltage without reference to the dimming mode, the third transistor including an input electrode receiving the first source voltage, a control electrode receiving the current-control voltage and an output electrode connected to the second transistor.

In example embodiments, the compensation data stored in the look-up table may be determined based on a single reference point preset on a voltage-current curve of the third transistor.

In accordance with still another embodiment of the present invention, an organic light emitting display device may include a display panel including a plurality of sub-pixels, and each of the sub-pixels including an organic light emitting element, a first transistor connected a data line and a gate line, a second transistor connected to the first transistor and the organic light emitting element, and a third transistor connected to the second transistor and adjusting a level of a current applied to the organic light emitting element, a data compensating part compensating image data using a plurality of look-up tables respectively corresponding to a plurality of dimming modes, to output compensation data, a data driving part converting the compensation data to a data voltage to provide the data line with the data voltage, and a scan driving part generating a scan signal to provide the gate line with the scan signal.

In example embodiments, the organic light emitting display device may further include a current-control voltage generating part providing the third transistor with a current-control voltage having a voltage difference with respect to a first source voltage, the voltage difference being different according to the dimming mode, the third transistor including an input electrode receiving the first source voltage, a control electrode receiving the current-control voltage and an output electrode connected to the second transistor.

In example embodiments, the compensation data stored in the plurality of look-up tables may be determined based on a plurality of reference points predetermined on a voltage-current curve of the third transistor.

In accordance with yet another embodiment of the present invention, an organic light emitting display device may include a display panel including a plurality of sub-pixels, and each of the sub-pixels including an organic light emitting element, a first transistor connected a data line and a gate line, a second transistor connected to the first transistor and the organic light emitting element, and a third transistor connected to the second transistor and adjusting a level of a current applied to the organic light emitting element, a data compensating part compensating image data using a look-up table to output compensation data, a data driving part converting the compensation data to a data voltage to provide the data line with the data voltage, and a scan driving part generating a scan signal to provide the scan signal with the gate line, the scan signal having a different pulse width according to the dimming mode.

In example embodiments, the organic light emitting display device may further include a timing control part adjusting the pulse width of the scan signal according to the dimming mode.

In example embodiments, the scan driving part may generate the scan signal having a first pulse width in a high dimming mode and generate the scan signal having a second pulse width less than the first pulse width in a low dimming mode.

In example embodiments, the organic light emitting display device may further include a current-control voltage generating part providing the third transistor with a current-control voltage. The current-control voltage generating part provides the organic light emitting element with the current-control voltage of a predetermined level fixed without reference to the dimming mode.

In example embodiments, the third transistor may include an input electrode receiving a first source voltage, a control electrode receiving the current-control voltage and an output electrode connected to the second transistor, and the current-control voltage generating part may provide the third transistor with the current-control voltage having a voltage difference with respect to the first source voltage without reference to the dimming mode.

In example embodiments, the compensation data stored in the look-up table are determined based on a single reference point preset on a voltage-current curve of the third transistor.

Therefore, the method of controlling a dimming operation and an organic light emitting display device for performing the method of controlling the dimming operation according to example embodiments may compensate the image data using the compensation data determined according to the dimming mode so that a compensation error may be decreased. Thus, an emitting period of the organic light emitting element may be minutely control in each of the dimming modes, so that power consumption may be decreased.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE EMBODIMENTS

Figure 1:
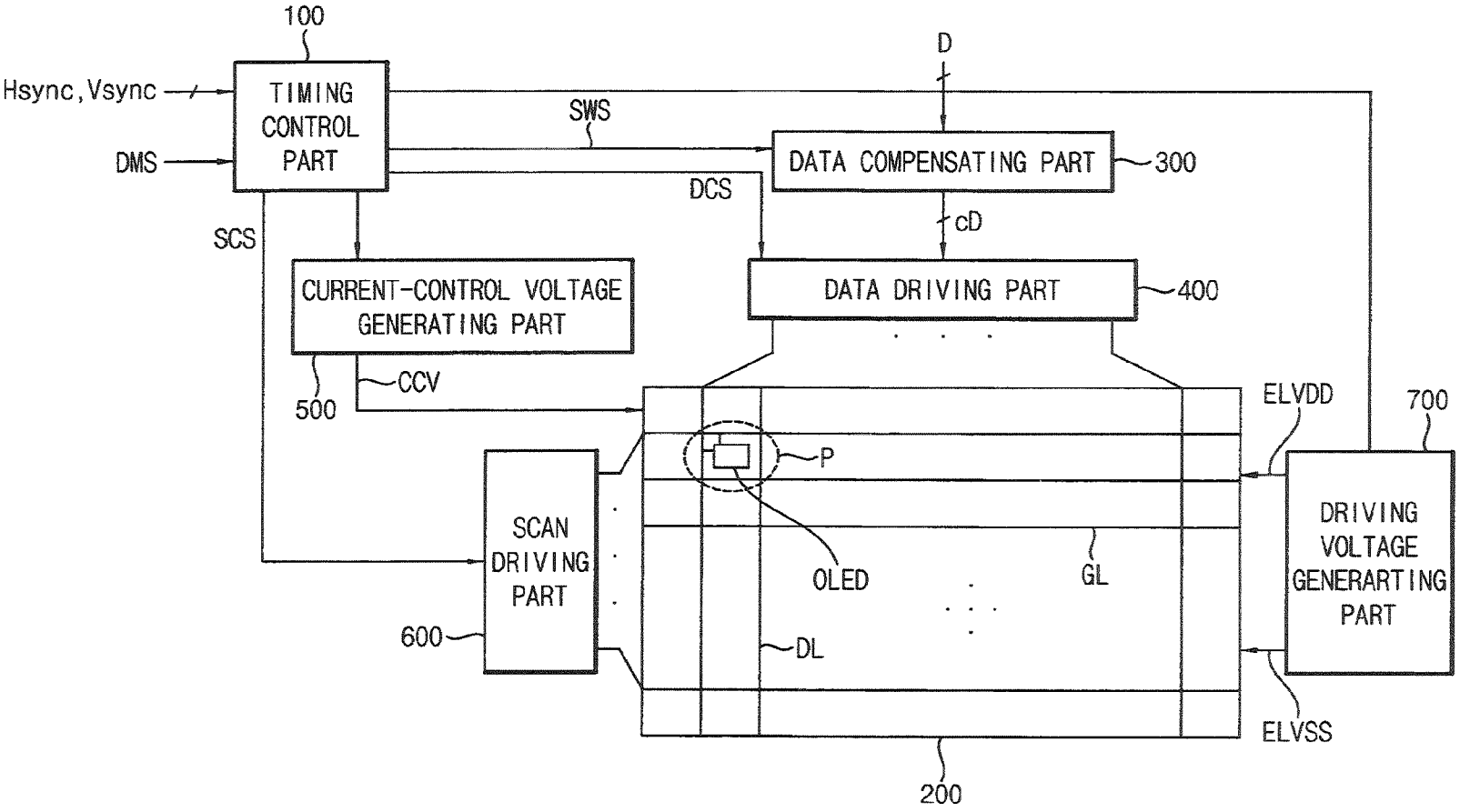
FIG. 1 is a block diagram illustrating an organic light emitting display device according to example embodiments.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
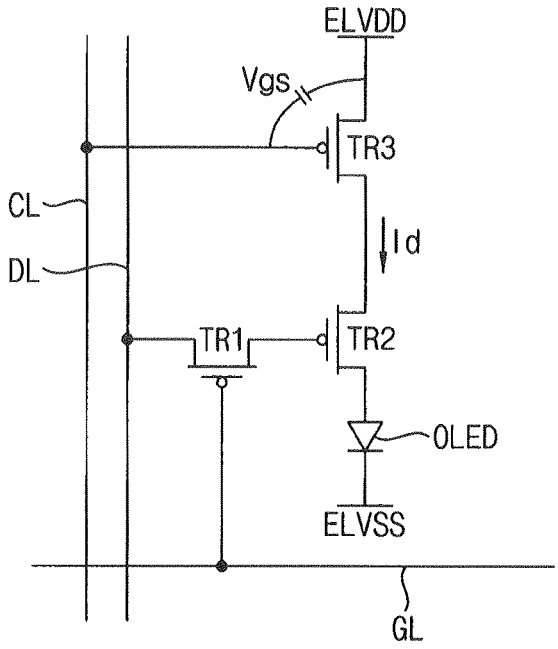
FIG. 2 is an equivalent circuit illustrating a sub-pixel as shown in FIG. 1.

FIG. 1 is a block diagram illustrating an organic light emitting display device according to example embodiments. FIG. 2 is an equivalent circuit illustrating a sub-pixel as shown in FIG. 1.

In reference to FIGS. 1 and 2, the organic light emitting display device may include a timing control part 100, a display panel 200, a data compensating part 300, a data driving part 400, a current-control voltage generating part 500, a scan driving part 600 and a driving voltage generating part 700.

The timing control part 100 generates a scan control signal SCS and a data control signal DCS based on vertical and horizontal synchronization signals Vsync and Hsync. In addition, according to the present example embodiment, the timing control part 100 generates a switching control signal SWS based on a dimming mode signal DMS to control the data compensating part 300. The timing control part 100 provides the scan driving part 600 with the scan control signal SCS, provides the data driving part 400 with the data control signal DCS and provides the data compensating part 400 with the switching control signal SWS.

The display panel 200 includes a plurality of data lines DL, a plurality of gate lines GL and a plurality of sub-pixels P. Each of the sub-pixels P includes an organic light emitting element OLED.

For example, in reference to an equivalent circuit of the sub-pixel as shown in FIG. 2, the sub-pixel P includes a first transistor TR1, a second transistor TR2, a third transistor TR3 and the organic light emitting element OLED.

The first transistor TR1 includes a control electrode connected to a gate line GL, an input electrode connected to a data line DL and an output electrode connected to the second transistor TR2.

The second transistor TR2 includes a control electrode connected to the first transistor TR1, an input electrode connected to the third transistor TR3 and an output electrode connected to the organic light emitting element OLED.

The third transistor TR3 includes a control electrode connected to a current control line CL, an input electrode receiving a first source voltage ELVDD and an output electrode connected to the second transistor TR2. The current control line CL may receive a current control voltage of a different level according to a dimming mode. An output current of the third transistor TR3 may be controlled by a voltage difference between the current control voltage CCV applied to the control electrode of the third transistor TR3 and the first source voltage ELVDD. In other words, a level of a current applied to the organic light emitting element OLED may be controlled by the voltage difference between the current control voltage CCV and the first source voltage ELVDD.

The organic light emitting element OLED includes an anode electrode connected to the third transistor TR3 and a cathode electrode receiving a second source voltage ELVSS.

When the scan signal is applied to the gate line GL, the first transistor TR1 is turned on and a data signal transferred through the data line is applied to the control electrode of the second transistor TR2. Thus, the second transistor T2 is turned on. When the current control voltage CCV of a predetermined level is applied to the control electrode of the third transistor TR3, the third transistor TR3 is turned on and an output current of the third transistor TR3 is applied to the organic light emitting element OLED during a turn-on period of the second transistor. The output current is determined by a voltage difference between the current control voltage CCV and the first source voltage ELVDD. Therefore, the organic light emitting element OLED receives the output current determined based on the current control voltage CCV during the turn-on period of the second transistor. A level of the current control voltage CCV may control a peak level of the current applied to the organic light emitting element OLED. The first transistor TR1 and the second transistor TR2 may control an emitting period during which the organic light emitting element OLED emits light.

The data compensating part 300 receives image data D, compensates the image data D and outputs compensation data cD corresponding to the image data D. The compensation data cD are configured to compensate a display stain occurred by a threshold voltage dispersion of the transistors in the sub-pixels. For example, the data compensating part 300 may include a look-up table ("LUT") which includes the compensation data corresponding to the image data. Although, not shown in figures, in an embodiment, the data compensating part 300 may be included in the timing control part 100. The data compensating part 300 will be explained after.

The data driving part 400 converts the compensation data cD to a data voltage using a reference gamma voltage, based on the data control signal DCS received from the timing control part 100. The data driving part 400 outputs the data voltage to the data line DL of the display panel 100.

The current-control voltage generating part 500 outputs the current control voltage CCV of a predetermined level corresponding to the dimming mode according to a control of the timing control part 100 to the current control line CL of the display panel 100. The current control voltage CCV may be applied to overall third transistors TR3 in the display panel 100 in common. For example, in a higher dimming mode, the current control voltage CCV of a first level is applied to the display panel 200. In a lower dimming mode, the current control voltage CCV of a second level being less than the first level is applied to the display panel 200. The voltage difference between the current control voltage of the first level and the first source voltage ELVDD is more than that of between the current control voltage of the second level and the first source voltage ELVDD.

The scan driving part 600 generates the scan signal based on the scan control signal SCS received from the timing control part 100. The scan driving part 600 sequentially provides the gate lines GL with the scan signal.

The driving voltage generating part 700 provides the display panel 100 with the first source voltage ELVDD and the second source voltage ELVSS. The first source voltage ELVDD is applied to the input electrode of the third transistor TR3 though the voltage line VL. The second source voltage ELVSS is applied to the cathode of the organic light emitting element OLED. The cathodes of the overall organic light emitting elements may be connected each other such as a single common electrode.

Figure 3:
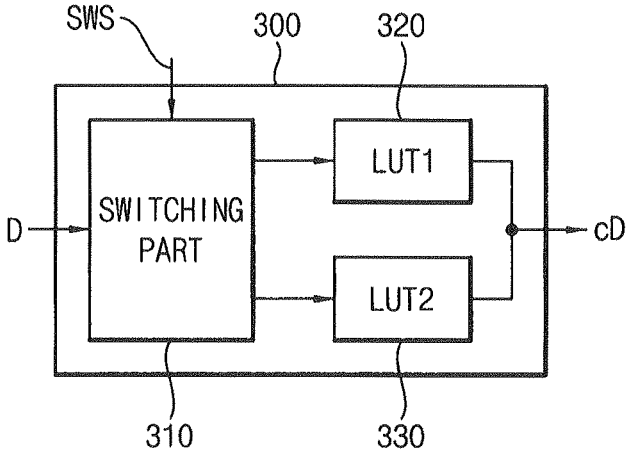
FIG. 3 is a block diagram illustrating a data compensating part as shown in FIG. 1.
Figure 4:
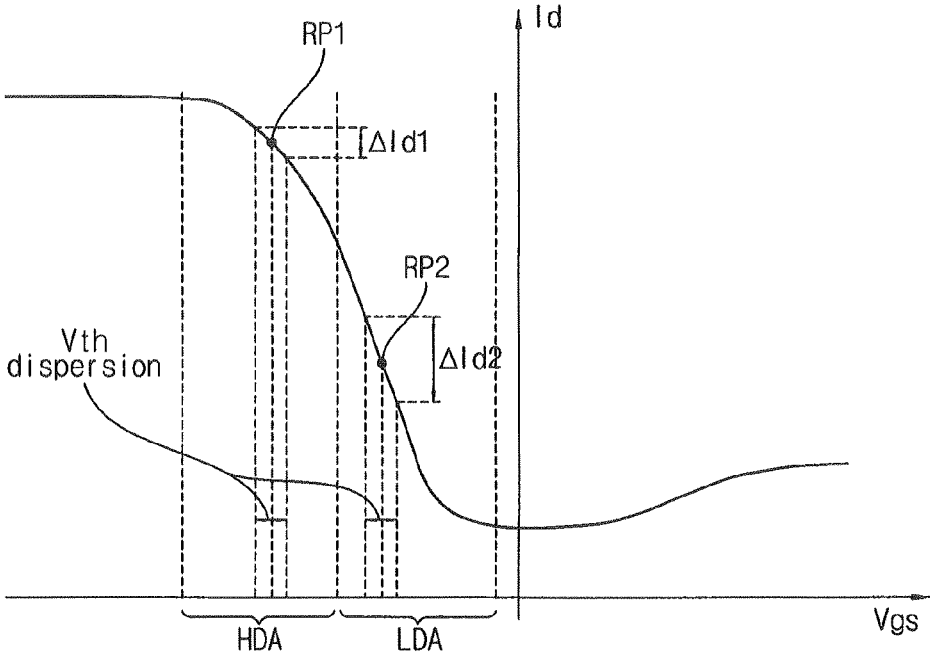
FIG. 4 is a current-voltage curve illustrating the data compensating part as shown in FIG. 3.

FIG. 3 is a block diagram illustrating a data compensating part as shown in FIG. 1. FIG. 4 is a current-voltage curve illustrating the data compensating part as shown in FIG. 3.

In reference to FIGS. 1, 3 and 4, the data compensating part 300 includes a switching part 310, a first LUT 320 and a second LUT 330.

The switching part 310 selects one of the first LUT 310 and the second LUT 320 in response to the switching control signal SWS received from the timing control part 100. Thus, the data compensating part 300 compensates the received image data using the LUT selected from the switching part 310 and outputs the compensation data cD.

The first LUT 320 stores high luminance compensation data predetermined corresponding to the high dimming mode. The second LUT 330 stores low luminance compensation data predetermined corresponding to the low dimming mode.

In reference to FIG. 4, in the third transistor TR3, the peak level of the output current Id may be determined by the voltage difference Vgs between the control electrode and the input electrode of the third transistor TR3. When the peak level of the output current Id increases, the organic light emitting element OLED may display the image having a high luminance. When the peak level of the output current Id decreases, the organic light emitting element OLED may display the image having a low luminance. Thus, the output current Id is divided into a high luminance dimming area HAD and a low luminance dimming area LDA according to the voltage difference Vgs.

In reference to a slope of the voltage-current curve, a variable breadth ΔId1 of the output current Id according to a variable breadth of the voltage difference Vgs in the high luminance dimming area HAD, is less than the variable breadth ΔId2 of the output current Id according to the variable breadth of the voltage difference Vgs in the low luminance dimming area LDA. In other words, in the low luminance dimming area LDA, the variable breadth ΔId2 of the output current Id according to the variable breadth of the voltage difference Vgs is relatively larger so that a luminance variable breadth of the organic light emitting element OLED may be increased.

According to the present example embodiment, reference points RP1 and RP2 are respectively determined in the high luminance dimming area HAD and the low luminance dimming area LDA. The compensation data are determined based on the dispersions of the threshold voltage Vth respectively corresponding to the reference points RP1 and RP2. As shown in FIG. 4, the high luminance compensation data of the high dimming mode are determined based on the dispersion of the threshold voltage Vth corresponding to a first reference point RP1 in the high luminance dimming area HDA. The low luminance compensation data of the low dimming mode are determined based on the dispersion of the threshold voltage Vth corresponding to a second reference point RP2 in the low luminance dimming area LDA.

Therefore, in the high dimming mode, the image data are compensated as the high luminance compensation data using the first LUT 320. In the low dimming mode, the image data are compensated as the low luminance compensation data using the second LUT 330.

According to the present example embodiment, the image data are compensated using the compensation data determined according to the dimming mode so that a compensation error may be decreased.

Figure 5:
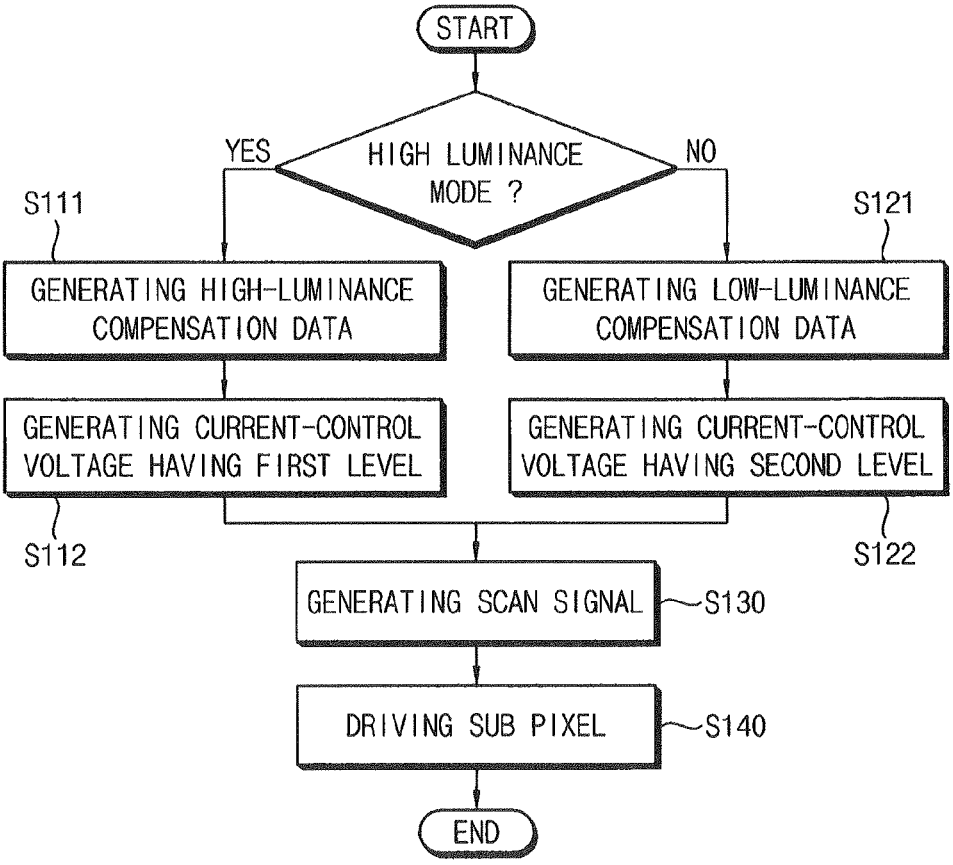
FIG. 5 is a flow chart illustrating a method of compensating image data according to the data compensating part as shown in FIG. 3.
Figure 6A:
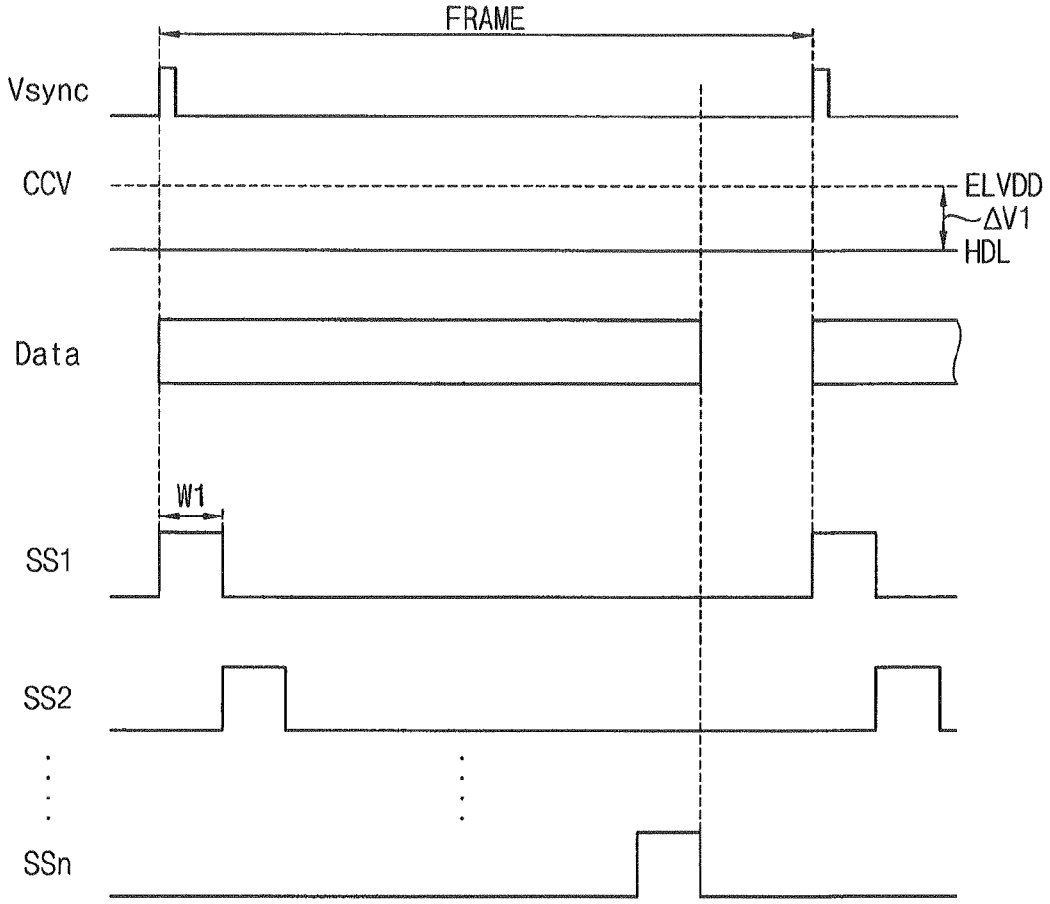
FIGS. 6A and 6B are waveforms illustrating a method of controlling a dimming operation according to the method of compensating image data as shown in FIG. 5.
Figure 6B:
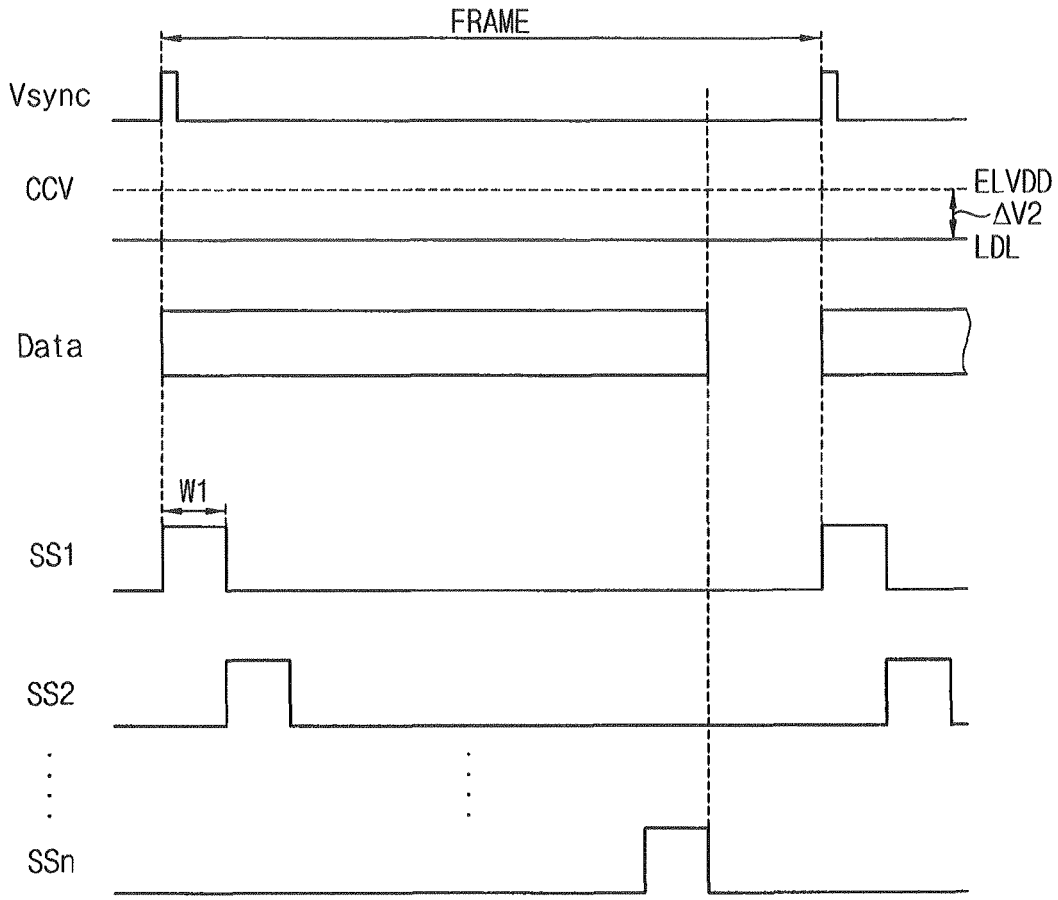

FIG. 5 is a flow chart illustrating a method of compensating image data according to the data compensating part as shown in FIG. 3. FIGS. 6A and 6B are waveforms illustrating a method of controlling a dimming operation according to the method of compensating image data as shown in FIG. 5.

In reference to FIGS. 1, 3 and 5, the timing control part 100 controls a dimming operation of the organic light emitting display device based on a dimming mode signal DMS received from an external device.

When the dimming mode signal DMS is a signal corresponding to the high dimming mode, the timing control part 100 provides the data compensating part 300 with a switching control signal SWS corresponding to the high dimming mode. The switching part 310 selects the first LUT 320 corresponding to the high dimming mode according to a control of the timing control part 100.

Therefore, the data compensating part 300 compensates the image data D using the first LUT 320 and outputs the high luminance compensation data cD corresponding to the image data D (Step S111).

In reference to FIG. 6A, in the high dimming mode, the current-control voltage generating part 500 generates the current control voltage CCV having a first level HDL corresponding to the high dimming mode (Step S112). The current control voltage CCV has a first voltage difference ΔV1 with respect to the first source voltage ELVDD. The current-control voltage generating part 500 provides the current control line CL of the display panel 200 with the current control voltage CCV having the first level HDL.

The data driving part 400 converts the high luminance compensation data cD received from the data compensating part 300 to the data voltage and provides the data line DL of the display panel 200 with the data voltage (Data). The scan driving part 600 generates the scan signal (Step S130). The scan signal has a first pulse width W1. For example, the first pulse width W1 may correspond to one horizontal period (1H). The scan driving part 600 sequentially provides the gate lines GL of the display panel 200 with the scan signals SS1, SS2, . . . , SSn (n is a natural number). In addition, the driving voltage generating part 700 generates the first source voltage ELVDD and the second source voltage ELVSS and outputs the first and second source voltages ELVDD and ELVSS to the display panel 200. As described above, the sub-pixel P displays the image of the high luminance in the high dimming mode (Step S140).

When the dimming mode signal DMS is a signal corresponding to the low dimming mode, the timing control part 100 provides the data compensating part 300 with the switching control signal SWS corresponding to the low dimming mode. The switching part 310 selects the second LUT 330 corresponding to the low dimming mode.

The data compensating part 300 compensates the image data using the second LUT 330 and outputs the low luminance compensation data (Step S121).

In reference to FIG. 6B, in the low dimming mode, the current-control voltage generating part 500 generates the current control voltage CCV having a second level LDL corresponding to the low dimming mode (Step S122). The current control voltage CCV has a second voltage difference ΔV2 being less than the first voltage difference ΔV1 with respect to the first source voltage ELVDD. The current-control voltage generating part 500 provides the current control line CL of the display panel 200 with the current control voltage CCV having the second level LDL.

The data driving part 400 converts the low luminance compensation data cD received from the data compensating part 300 to the data voltage and provides the data line DL of the display panel 200 with the data voltage (Data). The scan driving part 600 generates the scan signal having the first pulse width W1, and the scan driving part 600 provides the gate lines GL of the display panel 200 with the scan signals SS1, SS2, . . . , SSn (n is a normal number) (Step S130). The driving voltage generating part 700 generates the first source voltage ELVDD and the second source voltage ELVSS and outputs the first and second source voltages ELVDD and ELVSS to the display panel 200. As described above, the sub-pixel P displays the image of the low luminance in the low dimming mode (Step S140).

According to the present example embodiment, the image data is compensated using the compensation data determined according to the dimming mode so that a compensation error may be decreased. Thus, in each of the dimming modes, an emitting period of the organic light emitting element may be minutely control so that power consumption may be decreased.

Figure 7:
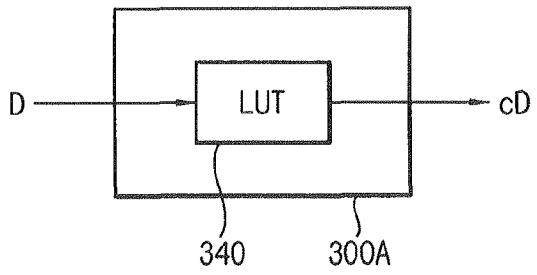
FIG. 7 is a block diagram illustrating a data compensating part according to example embodiments.

FIG. 7 is a block diagram illustrating a data compensating part according to example embodiments.

In reference to FIGS. 1, 4 and 7, the organic light emitting display device according to the present example embodiment includes the same elements as those of the previous example embodiment as shown in FIG. 1, except for the data compensating part 300A.

The data compensating part 300A includes a single LUT 340. In reference to the voltage-current curve as shown in FIG. 4, the LUT 340 stores the compensation data which is determined based on the dispersion of the threshold voltage Vth corresponding to the first reference point RP1 in the high luminance dimming area HDA. According to the present example embodiment, the data compensating part 300A compensates the image data using the compensation data stored in the LUT 340 without reference to the high dimming mode and the low dimming mode.

In addition, the current-control voltage generating part 500 according to the present example embodiment generates the current-control voltage CCV having the fixed level, for example, the first level, without reference to the high dimming mode and the low dimming mode.

According to the present example embodiment, a method of compensating image data includes adjusting turn-on periods of the first and second transistors TR1 and TR2 in the sub-pixel P in order to adjust an emitting period during which the organic light emitting element OLED emits the light.

According to the present example embodiment, the voltage difference Vgs of the third transistor in the low dimming mode is the same as that in the high dimming mode. However, the pulse width of the scan signal in the low dimming mode is different from that in the high dimming mode, such that the emitting period of the organic light emitting element OLED in the low dimming mode is different from that in the high dimming mode. Thus, a compensation error may be decreased.

Figure 8:
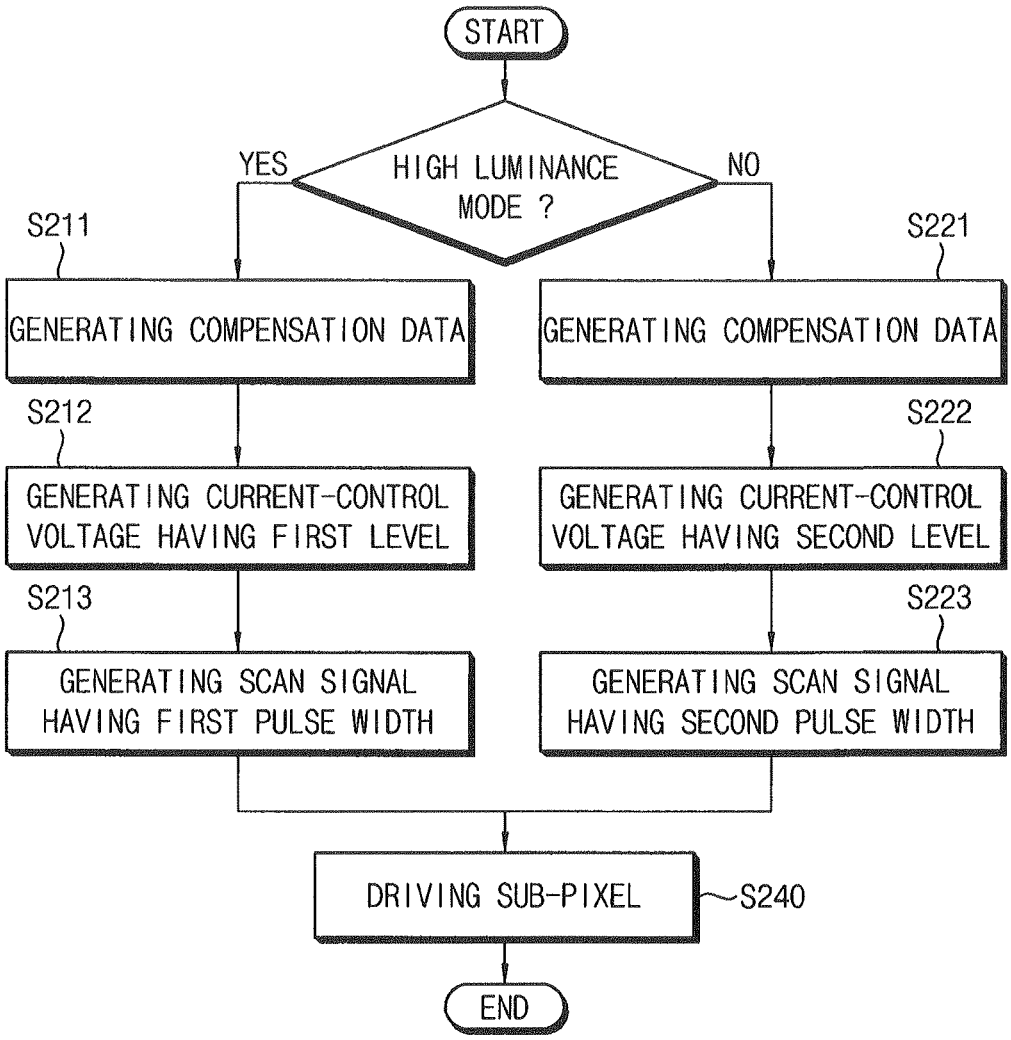
FIG. 8 is a flow chart illustrating a method of compensating image data according to example embodiments.
Figure 9:
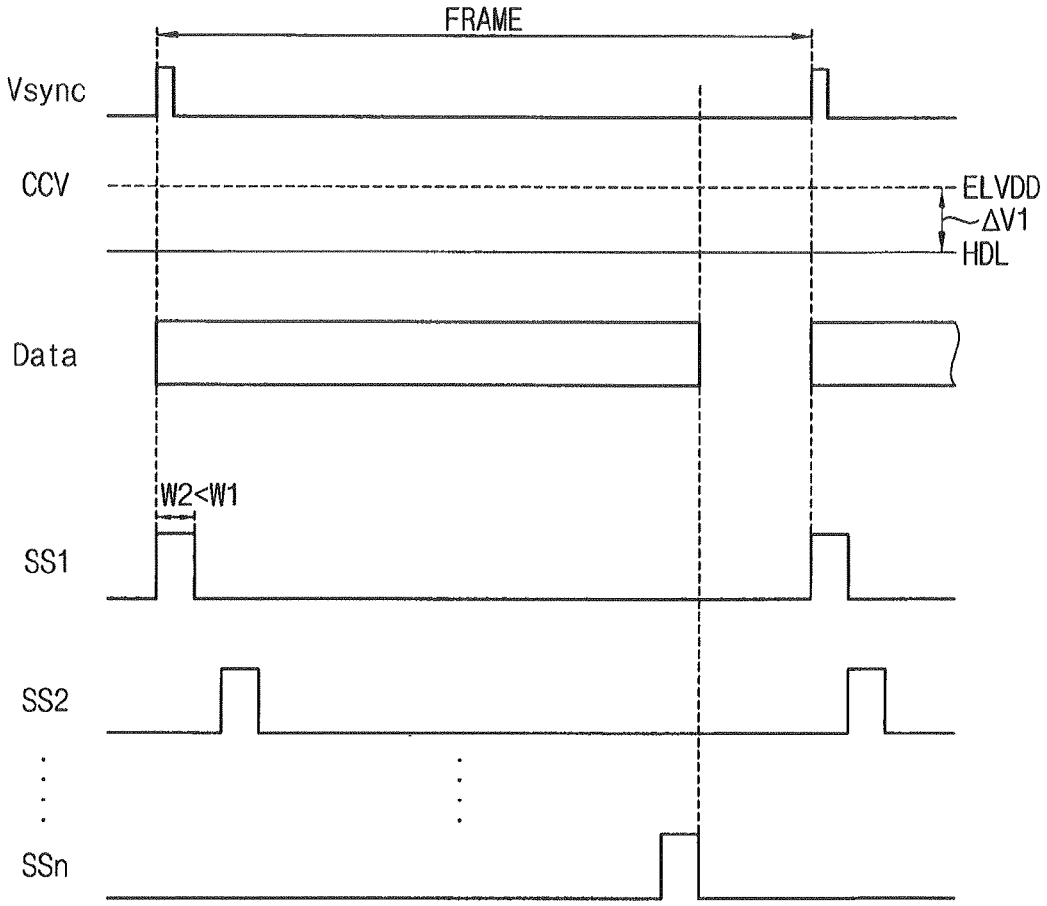
FIG. 9 is a waveform illustrating a method of controlling a dimming operation according to the method of compensating image data t as shown in FIG. 8.

FIG. 8 is a flow chart illustrating a method of compensating image data according to example embodiments. FIG. 9 is a waveform illustrating a method of controlling a dimming operation according to the method of compensating image data t as shown in FIG. 8.

In reference to FIGS. 1, 2 and 8, the timing control part 100 controls a dimming mode of the organic light emitting display device based on a dimming mode signal DMS received from an external device.

When the dimming mode signal DMS is a signal corresponding to the high dimming mode signal, a method of compensating image data according to the present example embodiment may be substantially the same as those of the previous example embodiment as described in FIG. 6A. The data compensating part 300 compensates the image data using the LUT 340 and outputs the compensation data cD (Step S211).

The current-control voltage generating part 500 generates a current control voltage CCV having a first level HDL (Step S212). The current control voltage CCV has the first voltage difference ΔV1 with respect to the first source voltage ELVDD.

The scan driving part 600 generates a scan signal having a first pulse width W1 (Step S213). The first pulse width W1 is determined corresponding to the high dimming mode. For example, the first pulse width W1 may correspond to one horizontal period (1H). The first and second transistors TR1 and TR2 are turned on during a turn-on period corresponding to the first pulse width W1. During the turn-on period during which first and second transistors TR1 and TR2 are turned on, the output current of the third transistor TR3 is applied to the organic light emitting element OLED. Thus, the organic light emitting element OLED may have an emitting period corresponding to the first pulse width W1.

The data driving part 400 converts the compensation data cD received from the data compensating part 300 to the data voltage and provides the data line DL of the display panel 200 with the data voltage (Data). The scan driving part 600 generates the scan signal having the first pulse width W1, and the scan driving part 600 provides the gate lines GL of the display panel 200 with the scan signals SS1, SS2, . . . , SSn (n is a natural number). The driving voltage generating part 700 generates the first source voltage ELVDD and the second source voltage ELVSS and outputs the first and second source voltages ELVDD and ELVSS to the display panel 200. As described above, the sub-pixel P displays the image of the high luminance in the high dimming mode (Step S240).

In reference to FIG. 8, when the dimming mode signal DMS is a signal corresponding to the low dimming mode, the method of compensating image data according to the present example embodiment is explained.

The data compensating part 300 compensates the image data using the LUT 340 and outputs the compensation data cD (Step S221).

The current-control voltage generating part 500 generates the current control voltage CCV having the first level HDL (Step S222). The current control voltage CCV has the first voltage difference ΔV1 with respect to the first source voltage ELVDD. The method of driving the data compensating part 300 and the current-control voltage generating part 500 is substantially the same as those of the high dimming mode.

The scan driving part 600 generates a scan signal having a second pulse width W2 being less than the first pulse width W1 (Step S223). The second pulse width W2 is determined corresponding to the low dimming mode. For example, the second pulse width W2 may have a pulse width being less than one horizontal period (1H). The first and second transistors TR1 and TR2 are turned on during a turn-on period corresponding to the second pulse width W2. During the turn-on period during which first and second transistors TR1 and TR2 are turned on, the output current of the third transistor TR3 is applied to the organic light emitting element OLED. Thus, the organic light emitting element OLED may have the emitting period corresponding to the second pulse width W2. However, the peak level of the current applied to the organic light emitting element OLED is substantially the same as that in the high dimming mode.

The data driving part 400 converts the compensation data cD received from the data compensating part 300 to the data voltage and provides the data line DL of the display panel 200 with the data voltage (Data). The scan driving part 600 generates the scan signal having the second pulse width W2, and the scan driving part 600 provides the gate lines GL of the display panel 200 with the scan signals SS1, SS2, . . . , SSn (n is a natural number). The driving voltage generating part 700 generates the first source voltage ELVDD and the second source voltage ELVSS and outputs the first and second source voltages ELVDD and ELVSS to the display panel 200. As described above, in the low dimming mode, the organic light emitting element OLED emits the light during the emitting period less than that of the high dimming mode such that the sub-pixel P displays the image of the low luminance (Step S240).

According to the present example embodiment, the number of the LUT may be decreased in comparison with the previous example embodiment as described in FIG. 3.

Figure 10:
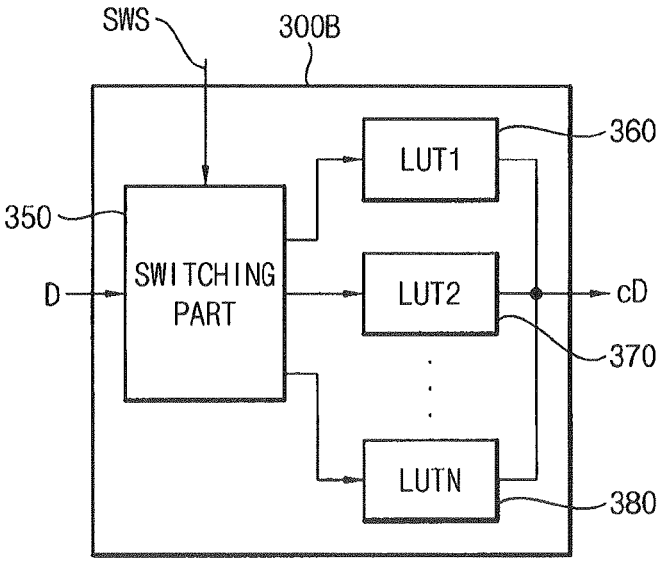
FIG. 10 is a block diagram illustrating a data compensating part according to example embodiments.
Figure 11:
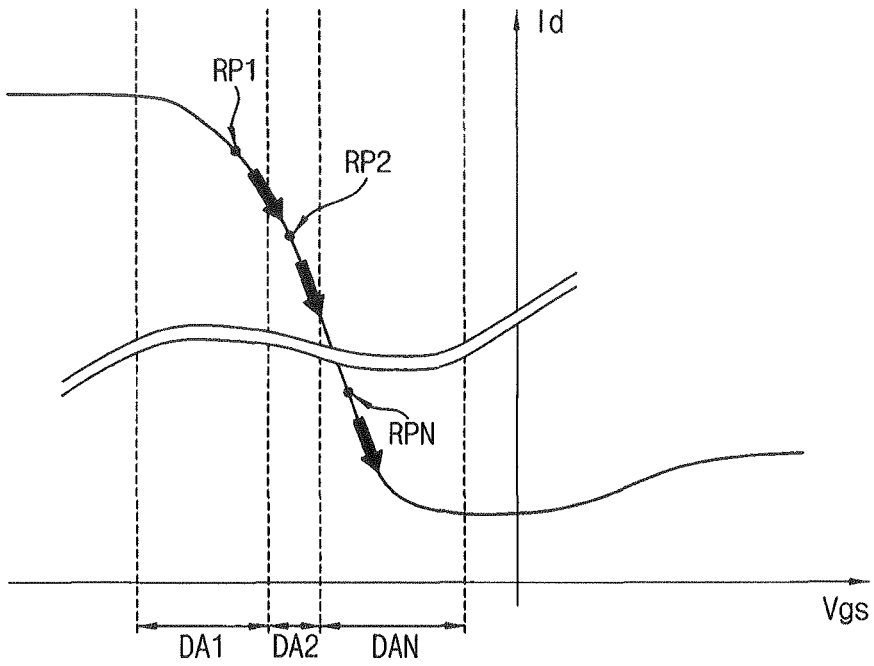
FIG. 11 is a current-voltage curve illustrating compensation data according to the data compensating part as shown in FIG. 10.

FIG. 10 is a block diagram illustrating a data compensating part according to example embodiments. FIG. 11 is a current-voltage curve illustrating compensation data according to the data compensating part as shown in FIG. 10.

In reference to FIGS. 1 and 10, the organic light emitting display device according to the present example embodiment includes the same elements as those of the previous example embodiment as shown in FIG. 1, except for the data compensating part 300B.

The data compensating part 300B according to the present example embodiment includes N LUTs corresponding to N (N is a natural number) dimming modes.

The data compensating part 300B includes a switching part 350 and first to N-th LUTs 360, 370 and 380.

The switching part 350 selects one of the first to N-th LUTs 360, 370 and 380 corresponding to dimming mode based on a control of the timing control part 100. The data compensating part 300B compensates image data D using the selected LUT from the switching part 350 and outputs compensation data cD.

The first LUT 360 stores first compensation data predetermined corresponding to a first dimming mode. The second LUT 370 stores second compensation data predetermined corresponding to a second dimming mode having a luminance lower than that of the first dimming mode. As described above, an N-th LUT 380 stores N-th compensation data corresponding to an N-th dimming mode having the lowest luminance.

In reference to FIG. 11, the voltage-current curve of the third transistor TR3 is divided into first to N-th dimming areas DA1, DA2, . . . , DAN according to the voltage difference Vgs of the third transistor TR3. The first dimming area DA1 is a maximum dimming area having the highest luminance and an N-th dimming area DAN is minimum dimming area having the lowest luminance.

According to the present example embodiment, a plurality of reference points RP1, RP2, . . . , RPN are determined in the first to N-th dimming areas DA1, DA2, . . . , DAN, respectively. The compensation data of the first to N-th dimming modes are determined based on the dispersion of the threshold voltage Vth respectively corresponding to the reference points RP1, RP2, . . . , RPN. For example, first compensation data of the first dimming mode are determined based on the dispersion of the threshold voltage Vth corresponding to a first reference point RP1 in the first dimming area DA1. Second compensation data of the second dimming mode are determined based on the dispersion of the threshold voltage Vth corresponding to a second reference point RP2 in the second dimming area DA2. As described above, N-th compensation data of the N-th dimming mode are determined based on the dispersion of the threshold voltage Vth corresponding to a N-th reference point RPN in the N-th dimming area DAN.

Therefore, the first to N-th compensation data are stored in the first to N-th LUTs 360, 370 and 380, respectively.

According to the present example embodiment, the image data is compensated using the compensation data determined according to the dimming mode so that a compensation error may be decreased. Thus, in each of the dimming modes, the emitting period of the organic light emitting element may be minutely control so that power consumption may be decreased.

Figure 12:
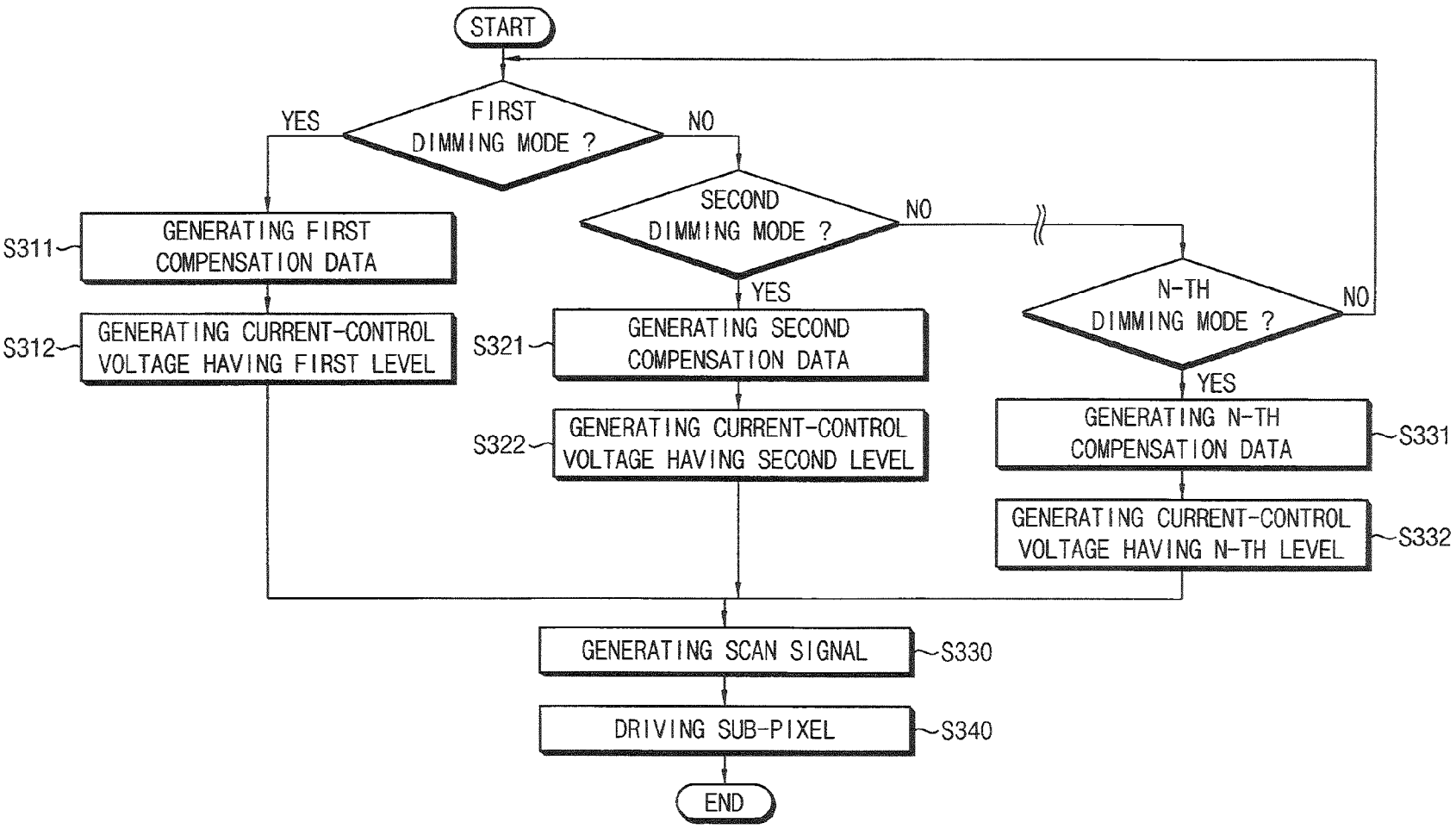
FIG. 12 is a flow chart illustrating a method of compensating image data according to the data compensating part as shown in FIG. 10.
Figure 13A:
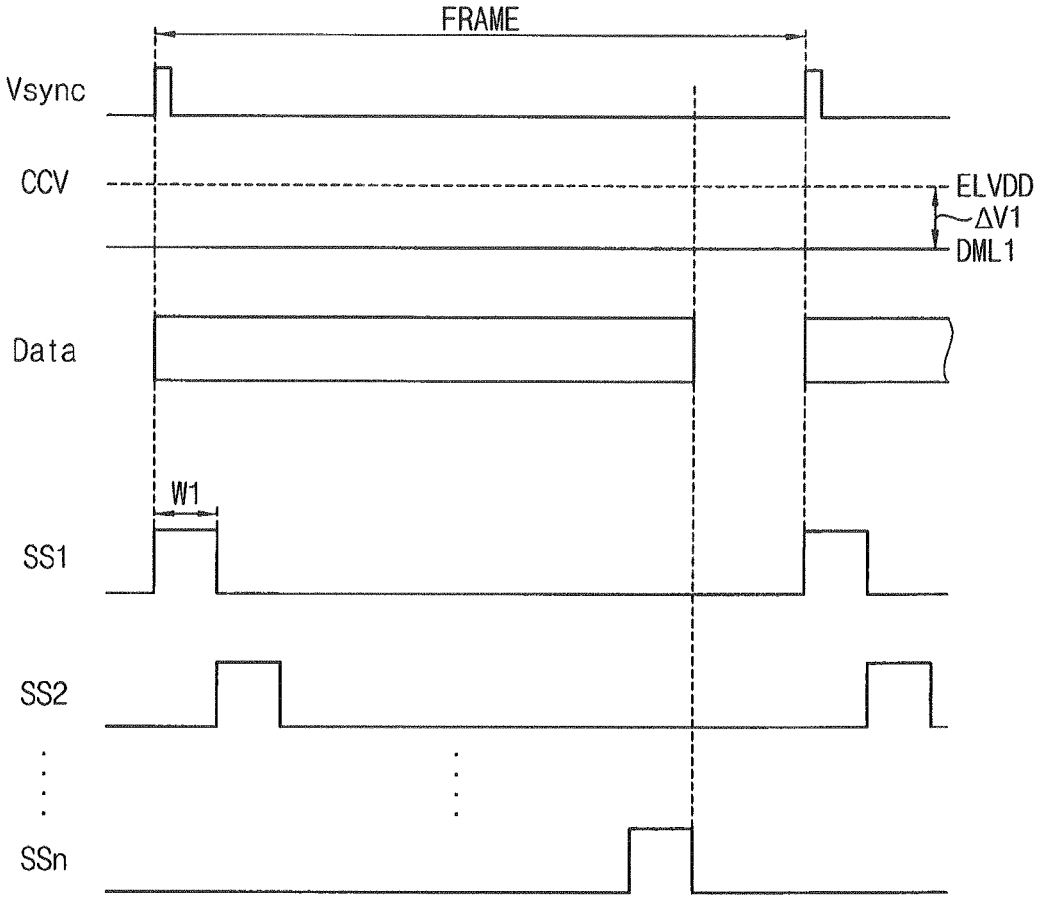
FIGS. 13A, 13B and 13C are waveforms illustrating a method of controlling a dimming operation according to the method of compensating image data as shown in FIG. 12.
Figure 13B:
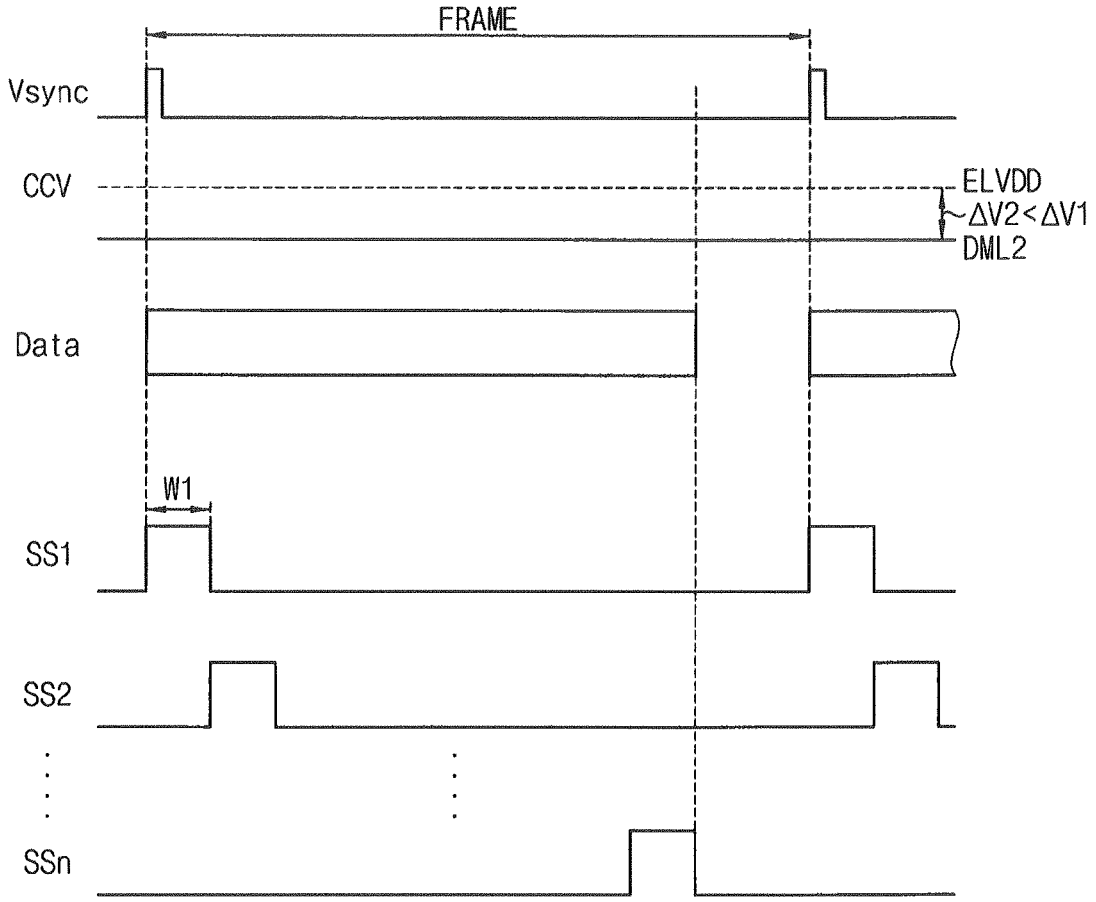
Figure 13C:
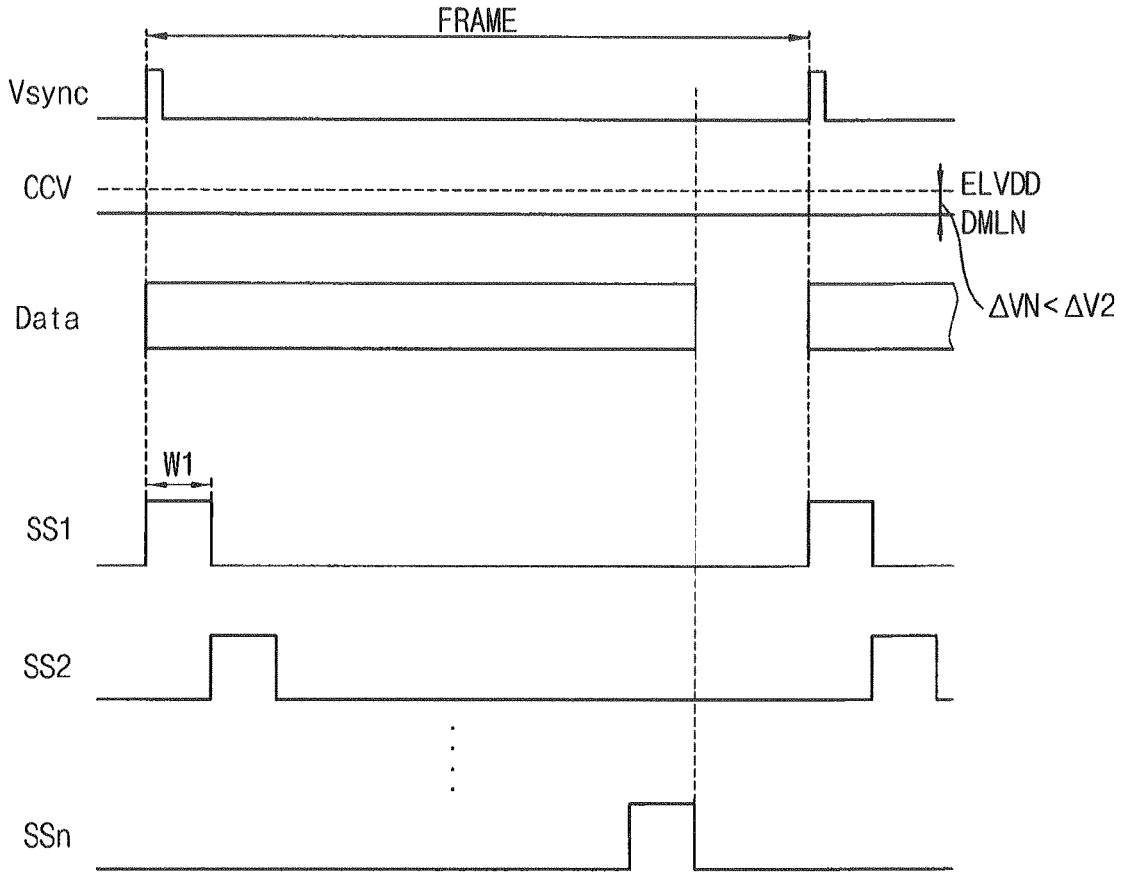

FIG. 12 is a flow chart illustrating a method of compensating image data according to the data compensating part as shown in FIG. 10. FIGS. 13A, 13B and 13C are waveforms illustrating a method of controlling a dimming operation according to the method of compensating image data as shown in FIG. 12.

In reference to FIGS. 1, 10 and 12, the timing control part 100 controls a dimming mode of the organic light emitting display device based on a dimming mode signal DMS received from an external device.

When the dimming mode signal DMS is a signal corresponding to the first dimming mode, the switching part 350 selects the first LUT 360. The data compensating part 300B compensates the image data D using the first LUT 360 and outputs the first compensation data cD (Step S311).

In reference to FIG. 13A, the current-control voltage generating part 500 generates the current control voltage CCV having a first level DML1 corresponding to the first dimming mode (Step S312). The current control voltage CCV has a first voltage difference ΔV1 with respect to the first source voltage ELVDD. The current-control voltage generating part 500 provides the current control line CL of the display panel 200 with the current control voltage CCV having the first level DML1.

The data driving part 400 converts the first compensation data received from the data compensating part 300 to the data voltage and provides the data line DL of the display panel 200 with the data voltage (Data). The scan driving part 600 generates the scan signal (Step S330). The scan driving part 600 sequentially provides the gate lines GL of the display panel 200 with the scan signals SS1, SS2, . . . , SSn (n is a natural number). In addition, the driving voltage generating part 700 generates the first source voltage ELVDD and the second source voltage ELVSS and outputs the first and second source voltages ELVDD and ELVSS to the display panel 200. As described above, the sub-pixel P displays the image having a first luminance in the first dimming mode (Step S340).

When the dimming mode signal DMS is a signal corresponding to the second dimming mode, the switching part 350 selects the second LUT 370. The data compensating part 300B compensates the image data D using the second LUT 370 and outputs the second compensation data cD (Step S321).

In reference to FIG. 13B, the current-control voltage generating part 500 generates the current control voltage CCV having a second level DML2 corresponding to the second dimming mode (Step S322). The current control voltage CCV has a second voltage difference ΔV2 with respect to the first source voltage ELVDD. The second voltage difference ΔV2 is less than the first voltage difference ΔV1. The current-control voltage generating part 500 provides the current control line CL of the display panel 200 with the current control voltage CCV having the second level DML2.

The data driving part 400 converts the second compensation data received from the data compensating part 300 to the data voltage and provides the data line DL of the display panel 200 with the data voltage (Data). The scan driving part 600 generates the scan signal (Step S330). The scan driving part 600 sequentially provides the gate lines GL of the display panel 200 with the scan signals SS1, SS2, . . . , SSn (n is a natural number). In addition, the driving voltage generating part 700 generates the first source voltage ELVDD and the second source voltage ELVSS and outputs the first and second source voltages ELVDD and ELVSS to the display panel 200. As described above, the sub-pixel P displays the image having a second luminance in the second dimming mode (Step S340).

When the dimming mode signal DMS is a signal corresponding to the N-th dimming mode, the switching part 350 selects the N-th LUT 380. The data compensating part 300B compensates the image data D using the N-th LUT 380 and outputs the N-th compensation data cD (Step S331).

In reference to FIG. 13C, the current-control voltage generating part 500 generates the current control voltage CCV having an N-th level DMLN corresponding to the N-th dimming mode (Step S332). The current control voltage CCV has an N-th voltage difference ΔVN with respect to the first source voltage ELVDD. The N-th voltage difference ΔVN is less than the first voltage difference ΔV1 and the second voltage difference ΔV2. The current-control voltage generating part 500 provides the current control line CL of the display panel 200 with the current control voltage CCV having the N-th level DMLN.

The data driving part 400 converts the N-th compensation data received from the data compensating part 300 to the data voltage and provides the data line DL of the display panel 200 with the data voltage (Data). The scan driving part 600 generates the scan signal (Step S330). The scan driving part 600 sequentially provides the gate lines GL of the display panel 200 with the scan signals SS1, SS2, . . . , SSn (n is a natural number). In addition, the driving voltage generating part 700 generates the first source voltage ELVDD and the second source voltage ELVSS and outputs the first and second source voltages ELVDD and ELVSS to the display panel 200. As described above, the sub-pixel P displays the image having an N-th luminance in the N-th dimming mode (Step S340).

According to the present example embodiment, the image data is compensated using the compensation data determined according to the dimming mode so that a compensation error may be decreased. Thus, in each of the dimming modes, an emitting period of the organic light emitting element may be minutely control so that power consumption may be decreased.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A method of controlling a dimming operation of an organic light emitting display device that includes an organic light emitting element, a first transistor connected to a data line and a gate line, and a second transistor connected to the first transistor and the organic light emitting element, the method comprising:

compensating image data using a plurality of look-up tables respectively corresponding to a plurality of dimming modes, to output compensation data corresponding to the image data;

converting the compensation data to a data voltage to provide the organic light emitting element with the data voltage; and adjusting a level of a current applied to the organic light emitting element according to each of the dimming modes, wherein the adjusting the level of the current comprising:

providing a third transistor with a current-control voltage having a voltage difference with respect to a first source voltage, the voltage difference being different according to the dimming mode, the third transistor including an input electrode receiving the first source voltage, a control electrode receiving the current-control voltage and an output electrode connected to the second transistor.

2. The method of claim 1, wherein the compensation data stored in the plurality of look-up tables are determined based on a plurality of reference points predetermined on a voltage-current curve of the third transistor.

3. A method of controlling a dimming operation of an organic light emitting display device that includes an organic light emitting element, a first transistor connected to a data line and a gate line, a second transistor connected to the first transistor and the organic light emitting element, the method comprising:

compensating image data using a look-up table to output compensation data; and adjusting a pulse width of a scan signal applied to the gate line according to each of a plurality of dimming modes, wherein the adjusting the pulse width comprising:

providing a third transistor with a current-control voltage having a voltage difference with respect to a first source voltage without reference to the dimming mode, the third transistor including an input electrode receiving the first source voltage, a control electrode receiving the current-control voltage and an output electrode connected to the second transistor.

4. The method of claim 3, wherein the adjusting the pulse width comprising:

adjusting the pulse width of the scan signal to a first pulse width in a high dimming mode; and adjusting the pulse width of the scan signal to a second pulse width less than the first pulse width in a low dimming mode.

5. The method of claim 4, further comprising:

providing the organic light emitting element with a current of a level fixed without reference to the dimming mode, the current passing through the organic light emitting element.

6. The method of claim 3, wherein the compensation data stored in the look-up table are determined based on a single reference point preset on a voltage-current curve of the third transistor.

7. An organic light emitting display device comprising:

a display panel including a plurality of sub-pixels, and each of the sub-pixels comprising an organic light emitting element, a first transistor connected a data line and a gate line, a second transistor connected to the first transistor and the organic light emitting element, and a third transistor connected to the second transistor and adjusting a level of a current applied to the organic light emitting element;

a data compensating part compensating image data using a plurality of look-up tables respectively corresponding to a plurality of dimming modes, to output compensation data;

a data driving part converting the compensation data to a data voltage to provide the data line with the data voltage; and a scan driving part generating a scan signal to provide the gate line with the scan signal.

8. The organic light emitting display device of claim 7, further comprising:

a current-control voltage generating part providing the third transistor with a current-control voltage having a voltage difference with respect to a first source voltage, the voltage difference being different according to the dimming mode, the third transistor including an input electrode receiving the first source voltage, a control electrode receiving the current-control voltage and an output electrode connected to the second transistor.

9. The organic light emitting display device of claim 7, wherein the compensation data stored in the plurality of look-up tables are determined based on a plurality of reference points predetermined on a voltage-current curve of the third transistor.

10. An organic light emitting display device comprising:

a display panel including a plurality of sub-pixels, and each of the sub-pixels comprising an organic light emitting element, a first transistor connected a data line and a gate line, a second transistor connected to the first transistor and the organic light emitting element, and a third transistor connected to the second transistor and adjusting a level of a current applied to the organic light emitting element;

a data compensating part compensating image data using a look-up table to output compensation data;

a data driving part converting the compensation data to a data voltage to provide the data line with the data voltage; and a scan driving part generating a scan signal to provide the scan signal with the gate line, the scan signal having a different pulse width according to the dimming mode.

11. The organic light emitting display device of claim 10, further comprising:

a timing control part adjusting the pulse width of the scan signal according to the dimming mode.

12. The organic light emitting display device of claim 11, wherein the scan driving part generates the scan signal having a first pulse width in a high dimming mode and generates the scan signal having a second pulse width less than the first pulse width in a low dimming mode.

13. The organic light emitting display device of claim 10, further comprising:

a current-control voltage generating part providing the third transistor with a current-control voltage, wherein the current-control voltage generating part provides the organic light emitting element with the current-control voltage of a predetermined level fixed without reference to the dimming mode.

14. The organic light emitting display device of claim 13, wherein the third transistor includes an input electrode receiving a first source voltage, a control electrode receiving the current-control voltage and an output electrode connected to the second transistor, and the current-control voltage generating part provides the third transistor with the current-control voltage having a voltage difference with respect to the first source voltage without reference to the dimming mode.

15. The organic light emitting display device of claim 10, wherein the compensation data stored in the look-up table are determined based on a single reference point predetermined on a voltage-current curve of the third transistor.

* * * * *